US005207202A

United States Patent [19]

Collingborn

[11] Patent Number: 5,207,202

[45] Date of Patent: May 4, 1993

[54] FUEL PUMPING APPARATUS

[75] Inventor: Peter A. G. Collingborn, Kent, England

[73] Assignee: Lucas Industries Public Limited Company, England

[21] Appl. No.: 686,786

[22] Filed: Apr. 17, 1991

[30] Foreign Application Priority Data

Apr. 17, 1990 [GB] United Kingdom ..... 9008566

[51] Int. Cl.[5] ..... F02M 41/00

[52] U.S. Cl. ..... 123/450; 123/506; 123/447

[58] Field of Search ..... 123/450, 506, 387, 386, 123/385, 447, 496, 504; 417/462, 440

[56] References Cited

U.S. PATENT DOCUMENTS

| | | | |
|---|---|---|---|
| 3,485,225 | 12/1969 | Bailey | 123/450 |
| 3,918,853 | 11/1975 | Drori | 123/450 |
| 4,029,071 | 6/1977 | Saito | 123/496 |
| 4,211,203 | 7/1980 | Kobayashi | 123/496 |
| 4,601,274 | 7/1986 | Seilly | 123/447 |
| 4,757,795 | 7/1988 | Kelly | 123/506 |
| 5,012,785 | 5/1991 | Long | 123/450 |
| 5,035,587 | 7/1991 | Collingborn | 123/450 |
| 5,044,898 | 9/1991 | Harris | 123/506 |
| 5,044,899 | 9/1991 | Nicol | 123/506 |

FOREIGN PATENT DOCUMENTS

| | | | |
|---|---|---|---|
| 0343759 | 11/1989 | European Pat. Off. | 123/450 |
| 1288359 | 1/1969 | Fed. Rep. of Germany . | |
| 1911916 | 12/1977 | Fed. Rep. of Germany . | |
| 2119030 | 4/1982 | United Kingdom . | |

*Primary Examiner*—Carl S. Miller

*Attorney, Agent, or Firm*—Andrus, Sceales, Starke & Sawall

[57] ABSTRACT

A fuel injection pumping apparatus of the rotary distributor type has a fixed stroke pumping plunger housed in a bore formed in a rotary distributor member. The pumping plunger is actuated by cam lobes formed on a cam ring. A piston housed in a cylinder is provided and one end of the cylinder is connected to the bore. The piston is spring biased towards the one end of the cylinder and the extent of movement of the piston away from the one end of the cylinder is limited by a stop. The piston absorbs the initial volume of fuel delivered by the pumping plunger as the latter is moved inwardly by the cam lobes thereby ensuring that fuel is delivered to an associated engine at a high rate.

5 Claims, 2 Drawing Sheets

FUEL PUMPING APPARATUS

This invention relates to a liquid fuel injection pumping apparatus of the kind comprising a rotary distributor member mounted in a body, a radial plunger bore in the distributor member and a pumping plunger in the bore, a cam follower located at the outer end of the pumping plunger, an annular cam ring surrounding the distributor member, a plurality of cam lobes on the internal surface of the cam ring, the cam follower engaging the leading flanks in turn of the cam lobes to impart inward movements to the pumping plunger as the distributor member rotates, a plurality of outlet ports formed in the body, passage means in the distributor member which connects the bore to the outlet ports in turn during successive inward movements of the pumping plunger, fuel supply means for feeding fuel to the bore in the intervals between inward movements of the pumping plunger thereby to move the plunger outwardly to its maximum extent, and valve means for spilling fuel from the bore during the inward movement of the pumping plunger thereby to control the quantity of fuel delivered through the outlet ports.

In known forms of distributor type fuel injection pumping apparatus it is common practice to provide stop rings which limit the extent of outward movement of the pumping plunger as fuel is supplied to the bore. Besides acting to determine the maximum amount of fuel which can be supplied through the outlet ports, the stop rings prevent contact between the initial portions of the leading flanks of the cam lobes and as a result the rate of delivery of fuel when the cam follower engages a cam lobe, is relatively high as compared with the rate of delivery which would occur if the cam follower were allowed to engage the initial portion of the cam lobe that is to say the portion leading directly from the base circle of the cam ring. Moreover, for a given volume of fuel delivered through the outlet ports, the period in terms of degrees of rotation of the distributor member would be extended if the initial portion of the cam were used. However the provision of stop rings which are usually disposed on each side of the cam ring, means that for a given axial space in which to locate the cam ring and stop rings, the width of the cam ring is restricted and this results in increased mechanical stress of the cam ring and the cam follower.

In order to overcome the need for stop rings and in accordance with one aspect of the invention, it is proposed to provide a piston which is contained within a cylinder and is biased towards one end thereof, the one end of the cylinder being connected to the bore. In this manner the fuel displaced during the initial movement of the pumping plunger is absorbed by movement of the piston within its cylinder. The fuel delivered from the plunger bore at the reduced rate therefore is absorbed and the desired high rate of fuel delivery through the pump outlet ports is obtained. Since the apparatus does not have the stop rings the cam ring and the cam followers can be as wide as the space available.

The modification described above is particularly useful with an apparatus in which the means for spilling the fuel includes a spring loaded control shuttle which is housed in a control shuttle cylinder and to one end of which fuel is supplied by an auxiliary plunger housed in a further radial bore in the distributor member. The auxiliary plunger is conveniently actuated by the same cam follower as the pumping plunger and since the initial inward movement of the auxiliary plunger will be at a low rate owing to the absence of the stop rings, the movement of the control shuttle against the action of its spring loading, will take place smoothly and this is advantageous so far as the control function of the shuttle is concerned.

It is convenient to form the cylinder which contains the piston in a further piston housed in a further cylinder. Means is provided to limit the extent of movement of the piston under the action of its spring relative to the further piston and the further piston is biased in the same direction towards one end of the further cylinder. The further piston defines a valve member for engagement with a seating formed in the wall at the one end of the further cylinder and the seating extends about a passage leading to the bore containing the pumping plunger. The one end of the cylinder containing the first mentioned piston communicates with the aforesaid passage and a stop is provided to limit the movement of the first mentioned piston against the action of its spring. The initial fuel displaced by the pumping plunger is absorbed by movement of the first mentioned piston into engagement with the stop and by admitting fuel under pressure into the one end of the further cylinder the valve member can be lifted from the seating to allow fuel displaced by the pumping plunger to flow into the further cylinder thereby terminating flow of fuel through the outlet ports. The flow of fuel into the further cylinder to initiate the initial movement of the further piston and the valve member can be controlled by the aforesaid control shuttle or by some other form of valve such as an electro-mechanically operable valve if the control shuttle is not provided.

An example of a fuel injection pumping apparatus in accordance with the invention will now be described with reference to the accompanying drawings in which.

Figure 1:
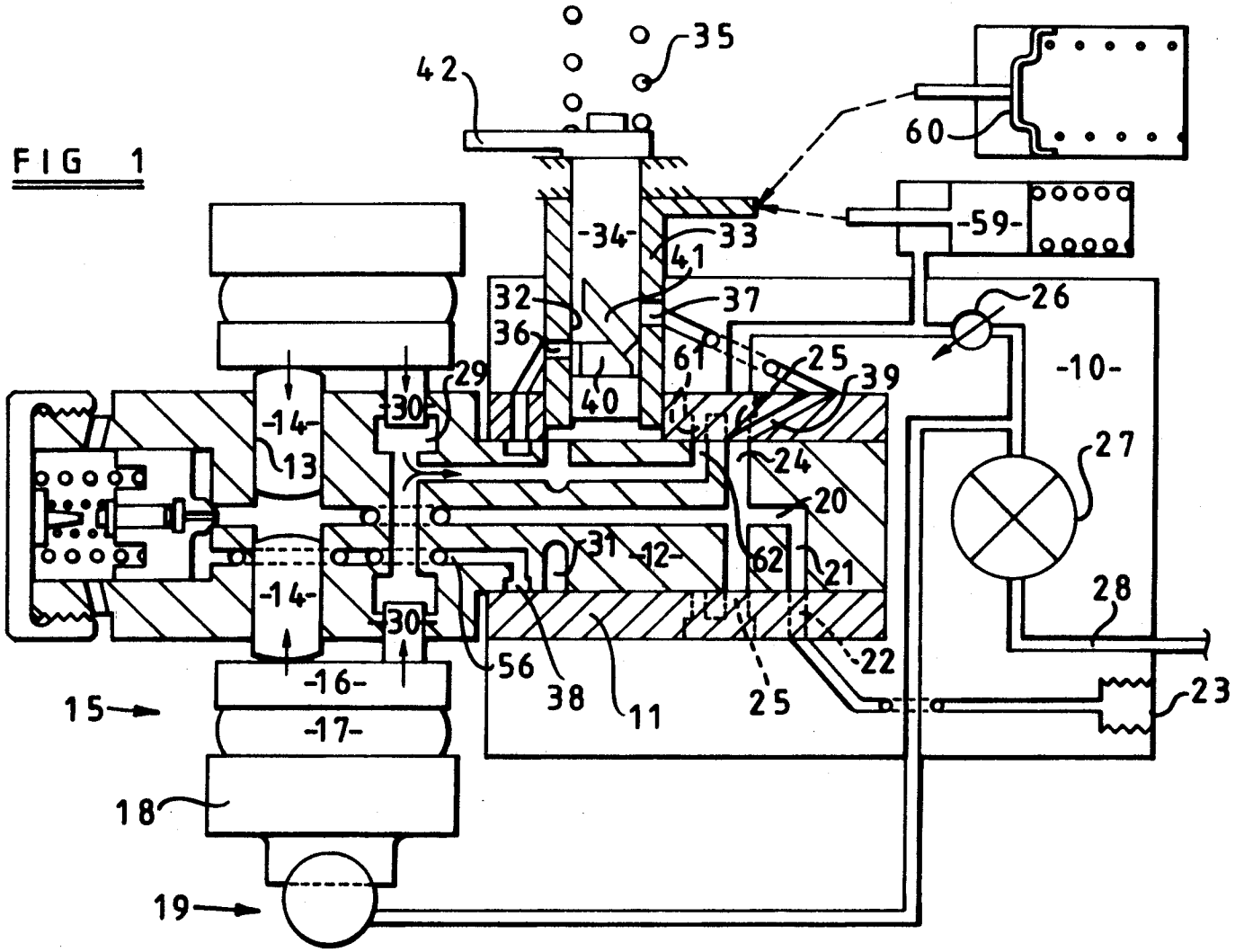
FIG. 1 is a diagrammatic part sectional view of the apparatus.

Referring to the drawings the apparatus comprises a body 10 in which is mounted a fixed sleeve 11 defining a bore to receive a rotary cylindrical distributor member 12. The distributor member has an enlarged diameter portion projecting from the bore and in use is driven in timed relationship with an associated engine.

Formed in the enlarged portion of the distributor member is a transverse bore 13 in which is mounted a pair of pumping plungers 14 the outer ends of which engage cam followers 15 each cam follower comprising a shoe 16 and a roller 17. The rollers engage the internal peripheral surface of an annular cam ring 18 which is mounted within the body 10. The angular position of the cam ring is adjustable by means of a fluid pressure operable piston 19, in known manner.

On the internal peripheral surface of the cam ring there is formed a plurality of pairs of cam lobes which extend from the base circle of the cam ring. As the distributor member rotates, the rollers engage with the leading flanks of the cam lobes to impart inward movement to the pumping plungers 14. The bore 13 is in communication with a longitudinal passage 20 which at one point communicates with a radially disposed delivery passage 21 positioned to register in turn with a plurality of outlet ports 22 formed in the sleeve and extending to outlets 23 respectively which are connected in use to the injection nozzles of the associated engine.

At another position the passage 20 is in communication with a plurality of radially disposed inlet passages 24 which are positioned to register in turn with inlet ports 25 formed in the sleeve 11 and communicating by way of an on/off valve 26, with the outlet of a low pressure fuel supply pump 27 having a fuel inlet 28. Although not shown, the inlet and outlet of the supply pump 27 are interconnected by way of a relief valve and the rotary part of the pump is coupled to the distributor member. By reason of the relief valve, the output pressure of the low pressure pump varies in accordance with the speed at which the distributor member is driven and the aforesaid piston 19 is subjected to the outlet pressure of the low pressure pump.

The passage 21 is arranged to register with an outlet port 22 during the whole time the plungers 14 can move inwardly so that fuel displaced from the bore 13 can flow to the associated engine. As the distributor member rotates and as the rollers move over the crests of the cam lobes, the passage 21 moves out of register with an outlet port 22 and an inlet passage 24 moves into register with an inlet port 25. Fuel is therefore supplied to the bore 13 from the outlet of the low pressure pump and the plungers 14 are moved outwardly their maximum extent so that the rollers engage the base circle of the cam ring. As described there is no method of controlling the quantity of fuel supplied through an outlet 23. In order to achieve the desired control, there is provided a further transverse bore 29 in the enlarged portion of the distributor member and located in the bore is a pair of auxiliary plungers 30 the outer ends of which engage the shoes 16 so that the auxiliary plungers are moved inwardly at the same time as the pumping plungers. The auxiliary plungers may be located in blind bores respectively. The bore 29 or the blind bores is/are in constant communication with a circumferential groove 31 formed in the periphery of the distributor member and this groove is in constant communication with one end of a shuttle cylinder 32 which for convenience is defined by the bore of a sleeve 33 which is angularly adjustable within the body part 10 but is restrained from axial movement. Slidable within the shuttle cylinder 32 is a shuttle 34 which is biased by means of a coiled compression spring 35 towards the one end of the cylinder.

Formed in the sleeve 33 is a pair of axially spaced ports 36 and 37. The port 36 is in constant 1 communication with a circumferential groove 38 formed on the distributor member while the port 37 is in constant communication with a port 39 which is formed in the sleeve and opens onto the periphery of the distributor member at a position to register with the inlet passages 24. The registration of the port 39 with an inlet passage is arranged to occur during the time the pumping plungers 14 are moved inwardly. The shuttle 34 is provided with a groove 40 which is in constant communication with the port 36 and extending from the groove 40 is an inclined groove 41 which as will be explained, is positioned to register with the port 37 after a predetermined movement of the shuttle. The shuttle is angularly adjustable and for this purpose is provided with an arm 42 which is coupled to a governor mechanism. By moving the shuttle 34 angularly the extent of movement of he shuttle away from said one end of the cylinder before the port 37 is brought into register with the groove 41, can be adjusted.

Figure 2:
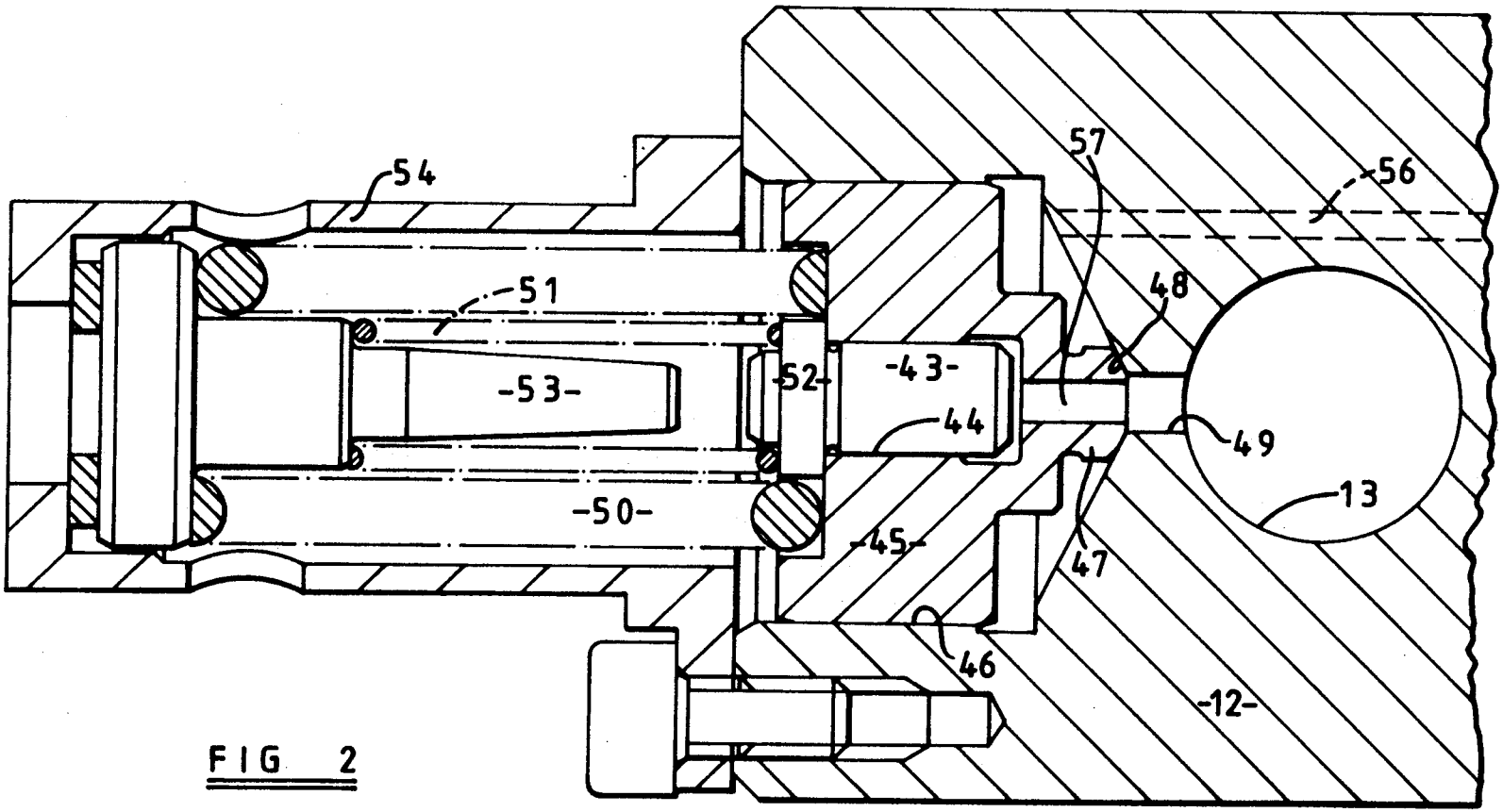
FIG. 2 is a view to an enlarged scale of part of the apparatus seen in FIG. 1.

Also provided and as shown in FIG. 2, is a piston 43 which is housed within a cylinder 44 defined in a further piston 45 movable within a cylinder 46 which is formed in an extension of the distributor member 12. The piston 45 has an extension which forms a valve member 47 which co-operates with a seating 48 defined in the end wall of the cylinder 46, the seating being located at the end of a passage 49 which communicates with the bore 13. The piston 45 is biased by a spring 50 so that the valve member 47 engages with the seating 48 and the piston 43 is biased by a spring 51 in the same direction, the extent of movement of the piston 43 under the action of its spring and relative to the piston 45 being limited by a flange 52 formed on the piston 43 and engaging with the end surface of the piston 45 remote from the valve member. In addition, a stop 53 is provided which limits the movement of the piston 43 away from the one end of the cylinder. The abutment for the springs is located in a tubular extension 54 which is secured to the distributor member, the interior of the extension being vented by suitable apertures formed therein. The groove 38 communicates with a space defined between the end wall of the cylinder 46 and the piston 45 by way of a passage 56. The inner end of the cylinder 44 communicates with the passage 49 by way of a drilling 57 extending through the valve member 47.

Operation starts with the items in the positions shown in FIG. 1 which corresponds to the commencement of inward movement of the pumping plungers 14 and the auxiliary plungers 30. As the distributor member rotates the plungers 14 will displace fuel from the bore 13 which will flow through the passage 57 to act upon the piston 43 to displace the piston against the action of its spring until it engages the stop 53. Once the stop is engaged no further fuel can be absorbed by movement of the piston 43 and delivery of fuel to the associated engine will take place through the outlet 23. Thus the fuel displaced by the initial movement of the plungers 14 as the rollers move over the initial portion of the cam lobes, is absorbed. At the same time the auxiliary plungers 30 are moved inwardly and fuel is displaced into the inner end of the cylinder 32 containing the shuttle. The shuttle therefore starts to move against the action of the spring 35 and this movement will continue so long as the plungers are moved inwardly. At some point during the movement of the shuttle the port 37 is brought into register with the groove 41 and fuel at the high pressure developed by the plungers 14 is supplied to the inner end of the cylinder 46 and this fuel acts upon the piston 45 to urge the piston against the action of the spring 50. As soon as the piston 45 does start to move the valve member 47 is lifted from its seating and the remaining fuel which is displaced by the plungers 14 can flow into the cylinder 46 displacing the piston 45 against the action of the spring 50. By varying the angular position of the shuttle 34 the extent of movement of the shuttle before the port 37 registers with the groove 41 can be controlled and therefore the position during the inward movement of the plungers 14 at which the valve member 47 is lifted from its seating to absorb the remaining quantity of fuel delivered by the plungers. Thus by moving the shuttle angularly the quantity of fuel which can be supplied to the associated engine can be varied. As stated, the arm 42 is connected to a governor mechanism which will be either of the so-called all-speed type or the so-called two-speed type. The sleeve 33 can also be moved angularly and two ways of achieving this are illustrated. In the first case a fluid pressure operable piston 59 is provided, the piston being spring biased against the action of the outlet pressure of the low pressure pump. By connecting the piston to the sleeve 33, so called torque control can be obtained. Another way of moving the sleeve which may be an alternative to or in addition to the piston 59, is by means of an air pressure responsive diaphragm 60 which is responsive to the pressure of air delivered to the associated engine.

When the plungers complete their inward movement as the rollers move over the crests of the cam lobes, the plungers can move outwardly and fuel is returned from the one end of the cylinder 46 to the bore 13 by movement of the piston 45 by the spring 50. In addition, the piston 43 will be moved relative to the piston 45 by the spring 51 and the fuel displaced from the cylinder 44 will also be returned to the bore 13. However, since fuel may have been supplied to the associated engine, fuel is supplied through one of the inlet passages 24 to the bore 13 to ensure that the plungers move outwardly their maximum extent. The spring 35 will also urge the shuttle 34 towards the inner end of the cylinder and during this movement fuel will be supplied to the bore 29. Any additional fuel which is required to make up for leakage, is supplied by means of an auxiliary filling port 61 connected to the outlet of the fuel supply pump and communicating at the appropriate time, with a passage 62 in the distributor member and which is in communication with the bore 29.

Although the apparatus as described employs a shuttle to control the supply of fuel at high pressure to the cylinder 46, it is possible to replace the shuttle and the plungers 30 by means of an electromagnetically operable valve which in effect when so required, connects the port 39 with the cylinder 46.

The diameter of the seating 48 is less than or equal to the diameter of the piston 43 and this means that where the seat diameter is less than the diameter of the piston 43, the fuel pressure within the cylinder 44 acts upon the end wall of the cylinder to create a force greater than the force developed by the pressure of fuel acting within the area defined by the seating. The balance of these forces therefore assists the action of the spring 50 in maintaining the valve member in contact with the seating. Where the seat diameter is equal to the diameter of the piston 43, the valve member 47 will be held in contact with the seating by the force exerted by the spring 50 alone.

In the event that the piston 43 sticks in the cylinder 44 in the position shown in FIG. 1, then as soon as the inward movement of the pumping plungers takes place, the fuel pressure will be conveyed through the passage 49 and the drilling 57 and will act upon the unbalanced end of the piston 43 to produce a force which is sufficient to move the two pistons against the action of their respective springs and as soon as such action takes place the valve member is lifted from the seating so that all the fuel displaced by the pumping plungers will be admitted to the one end of the cylinder 46 and no fuel will be supplied to the associated engine. It will of course be appreciated that the volume of fuel required to displace the piston 45 into contact with the flange 52 after the piston 43 has engaged the stop 53, is greater than the total displacement of the pumping plungers.

When the shuttle is set to provide zero fuel such as might occur in engine over-run conditions, the initial displacement of fuel by the pumping plungers will be absorbed by the movement of piston 43 which because it is spring loaded, and because of its inertia, will generate a pressure below the opening pressure of the nozzle. Moreover, under overrun conditions the governor rotates the shuttle 34 beyond the nominal zero fuel position so that the connection between ports 36 and 37 is already established at the start of plunger movement and the pressure will be applied to the piston 45 and the valve member 47 lifted from the seating before the piston 43 engages the stop 53. Any fuel displaced by the plungers 14 will therefore be absorbed thereby ensuring that no fuel is supplied to the associated engine.

By the arrangement described the initial slow rate of delivery of fuel by the plungers 14 is avoided. Moreover, a rapid reduction of pressure at the outlet port takes place when the valve member 47 is moved away from the seating 48 and this ensures rapid closure of the valve member in the fuel injection nozzles of the engine. In some cases the reduction of pressure may be too rapid so that unduly large pressure waves are generated in the pipeline connecting the outlets with the nozzles. In such cases the movement of the piston 45 may be retarded by reducing the size of the apertures in the tubular extension 54.

I claim:

1. A liquid fuel injection pumping apparatus comprising a rotary distributor member mounted in a body, a radial plunger bore in the distributor member and a pumping plunger in the bore, a cam follower located at the outer end of the plunger and engageable in turn with a plurality of cam lobes formed on the internal peripheral surface of an annular cam ring, the cam lobes having leading flanks which impart inward movement to the pumping plunger as the distributor member rotates and trailing flanks which allow outward movement of the pumping plunger, a plurality of outlet ports formed in the body, passage means in the distributor member which connect the bore to the outlet ports in turn during successive inward movements of the pumping plunger, fuel supply means for feeding fuel to the bore in the intervals between inward movements of the pumping plunger thereby to move the pumping plunger outwardly its maximum extent and adjustable valve means operable to spill fuel from the bore during the inward movement of the pumping plunger to terminate delivery of fuel, thereby to control the quantity of fuel delivered through the outlet ports, a piston slidable in a cylinder formed in a part associated and rotatable with the distributor member, resilient means biasing the piston towards one end of the cylinder, a passage in the distributor member which connects the one end of the cylinder with the bore and a stop to limit the movement of the piston, the piston acting to absorb the fuel expelled from the bore during the initial inward movement of the pumping plunger.

2. An apparatus according to claim 1, in which said cylinder is formed in a further piston slidable within a further cylinder formed in the distributor member, said further piston having an extension defining a valve member, resilient means biasing said further piston so that the valve member engages a seating which opens into the further cylinder and is formed about the passage, the apparatus including a control valve operable to admit fuel under pressure into said further cylinder to initiate movement of the further piston against the action of its resilient means, movement of the further, piston by the fuel under pressure acting to lift the valve member from the seating to allow fuel to spill from the bore into the further cylinder.

3. An apparatus according to claim 2, in which said control valve comprises an axially movable shuttle slidable in a shuttle cylinder, a spring biasing the shuttle to one end of said shuttle cylinder, an auxiliary plunger movable inwardly a the same time as said pumping plunger, passage means for conveying liquid displaced by the auxiliary plunger to the one end of the shuttle cylinder to effect outward movement of the shuttle against the action of the spring, and a flow path which is opened after a predetermined movement of the shuttle against the action of the spring to allow fuel under pressure to flow through said flow path into said one end of said further cylinder.

4. An apparatus according to claim 3, in which said shuttle is angularly adjustable to vary the extent of movement of the shuttle before flow through said flow path is established.

5. An apparatus according to claim 4, in which said fuel under pressure is derived from the plunger bore.

* * * * *